United States Patent [19]

Jalbert

[11] 4,174,950

[45] Nov. 20, 1979

[54] CERAMIC BASE AND CAP USEFUL IN FIRING CERAMIC SHELL MOLDS

[75] Inventor: Henry A. Jalbert, Willimantic, Conn.

[73] Assignee: United Technologies Corporation, Hartford, Conn.

[21] Appl. No.: 861,777

[22] Filed: Dec. 19, 1977

[51] Int. Cl.[2] ..... F27D 5/00

[52] U.S. Cl. ..... 432/6; 432/258; 432/261; 264/57; 248/346.1

[58] Field of Search ..... 432/5, 6, 253, 258, 432/259, 261, 260; 264/57, 58; 34/105; 248/346.1

[56] References Cited

U.S. PATENT DOCUMENTS

| | | | |
|---|---|---|---|
| 2,148,463 | 2/1939 | Harris | 432/261 |
| 2,450,836 | 10/1948 | Levy et al. | 432/261 |
| 2,595,961 | 5/1952 | Layne | 248/346.1 |
| 3,343,774 | 9/1967 | Pryor | 248/346.1 |
| 3,352,551 | 11/1967 | Kennedy | 432/260 |
| 3,778,224 | 12/1973 | Duffner | 432/259 |
| 3,854,186 | 12/1974 | Sergeys | 264/58 |
| 3,904,356 | 9/1975 | Hill et al. | 432/260 |

FOREIGN PATENT DOCUMENTS

| | | | |
|---|---|---|---|
| 1456683 | 11/1976 | United Kingdom | 432/258 |

*Primary Examiner*—Henry C. Yuen

*Attorney, Agent, or Firm*—Edward J. Timmer; Charles G. Nessler

[57] ABSTRACT

Disclosed is a preformed ceramic base useful in firing an open-ended ceramic shell mold having a mold base prior to metal casting. The ceramic firing base includes a working surface having a majority of flat surface portions for supporting the mold base during firing and one or more groove-like surface portions which define gas circulation passages from the outside atmosphere into the open mold bottom when the mold base is placed in supported relation on the flat surface portions. The ceramic firing base thereby enables firing of a green shell mold while maintaining mold base flatness and circulation of furnace gas into the mold cavity to minimize mold hot spots. Also disclosed is a preformed ceramic firing cap to be used in conjunction with the ceramic firing base, the firing cap being adapted to cover the open top end of the shell mold to prevent foreign particulate from entering the mold. The firing cap includes a working surface comprising a majority of flat surface portions for resting on the top of the mold and one or more groove-like surface portions extending from inside to outside the mold for purposes of gas circulation.

11 Claims, 3 Drawing Figures

CERAMIC BASE AND CAP USEFUL IN FIRING CERAMIC SHELL MOLDS

BACKGROUND OF THE INVENTION

1. Field of the Invention

The present invention relates to ceramic shell molds and, more particularly, to means for their manufacture, especially for the firing of ceramic molds at elevated temperatures.

2. Description of the Prior Art

In casting directionally solidified articles, either columnar grained as taught in the VerSnyder patent, U.S. Pat. No. 3,260,505, or single crystal as taught in the Piearcey patent, U.S. Pat. No. 3,494,709, it is common to solidify the molten metal in a casting assembly comprising an open-ended ceramic shell mold having a flat base positioned on a chill plate. The shell mold may be fabricated to produce a single cast article or a plurality of articles at one time and to this end includes one or more mold cavities in the shape of the article to be cast. Generally, the ceramic shell molds utilized have an open end above the mold cavity through which molten metal is introduced and an open end below the mold cavity through the mold base to allow contact between the molten metal and chill plate for unidirectional solidification. Of course, it is essential that mold base flatness be maintained to prevent leakage or runout of molten metal between the mold base and chill plate during casting.

Ceramic shell molds for use in these directional solidification processes can be formed by the lost wax process wherein a wax article pattern having a flat wax base is repeatedly dipped in ceramic slurry, dusted with ceramic stucco and dried until the desired thickness for a mold wall and base is obtained. After removal of the wax pattern and base, the green ceramic shell mold is fired at elevated temperatures, such as 1800° F., to impart sufficient strength thereto to withstand casting stresses. However, the firing step has been found to be a source of mold base unevenness or irregularity. Usually, the green shell mold base is positioned on a metal furnace tray for firing, such furnace trays oftentimes having a nonflat surface as a result of warpage and thermal distortion from numerous mold firings. It has been discovered that when the green mold base is placed on an uneven furnace tray surface, the base tends to conform to the tray surface during firing, resulting in the observed unevenness which leads to molten metal runout. In the past, molds having such defective bases have been subjected to a further operation to provide the required mold base flatness, such operation including abrading the mold base with suitable grit paper until adequate flatness is achieved. In addition to being a time consuming, laborious process, sanding of the mold base is also disadvantageous since it introduces ceramic inclusions into the mold which inclusions oftentimes ultimately appear in articles cast in the molds. Of course, the presence of inclusions in the cast articles adversely affects their quality and mechanical properties and leads to their rejection.

Another problem associated with the prior art firing step is that hot spots develop in the green shell mold due to inadequate circulation of the furnace atmosphere therethrough as a result of the bottom mold opening being closed off by the furnace tray. These hot spots manifest themselves in the form of cracks, bulges and the like which defects are, of course, cause for mold rejection.

A further problem associated with the firing step is that loose ceramic particulate inside the firing furnace sometimes falls into the shell molds. As explained above, these inclusions can adversely affect the quality of the casting produced.

SUMMARY OF THE INVENTION

According to one embodiment of the invention, a preformed ceramic base is provided for use in firing an open-ended ceramic shell mold which includes a mold base. The ceramic firing base is characterized by a working surface comprising a majority of uniformly flat surface portions on which the mold base is supported during firing and one or more groove-like surface portions which define one or more gas circulation passages from the outside atmosphere into the mold opening adjacent the firing base when the mold base is placed in supported relation on the flat surface portions. The groove-like surface portions are critically dimensioned and spaced relative to the flat surface portions so that the portion of the mold base spanning the surface grooves does not deform or conform thereto during firing. Thus, with the preformed ceramic firing base of the invention, a green ceramic shell mold can be fired at elevated temperatures while maintaining uniform mold base flatness and providing circulation of the furnace atmosphere through the mold to minimize hot spots.

In a preferred ceramic firing base, the groove-like surface portions are arranged in cross-hatched fashion across the working surface to define intersecting gas circulation passages when the mold base is supported on the flat surface portions, the circulation passages terminating at spaced locations around the edge periphery of the ceramic firing base. When a plurality of such preferred ceramic firing bases are arranged side by side so that the ends of the gas circulation passages around the edge peripheries are aligned in opposed gas flow relation with one another, a plurality of green ceramic shell molds, each of which is positioned on a firing base, can be simultaneously fired while uniform mold base flatness is maintained for each and circulation of the furnace atmosphere is maintained through each to minimize hot spots.

According to another embodiment of the invention, a preformed ceramic firing cap is utilized in conjunction with the preformed ceramic firing base, the cap being adapted to cover the open top of the green ceramic shell mold to prevent foreign particulate in the furnace from entering the open top of the mold. The ceramic firing cap is characterized by a working surface having a majority of flat surface portions which rest on the top of the mold and one or more groove-like surface portions extending from inside to outside the mold interior to allow circulation of furnace gases therethrough. Both the firing base and cap are fabricated from a heat and thermal shock resistant ceramic, such as alumina or zircon.

These and other advantages and objects of the present invention will become more fully apparent from the following drawings and detailed description of preferred embodiments.

DESCRIPTION OF PREFERRED EMBODIMENTS

Figure 1:
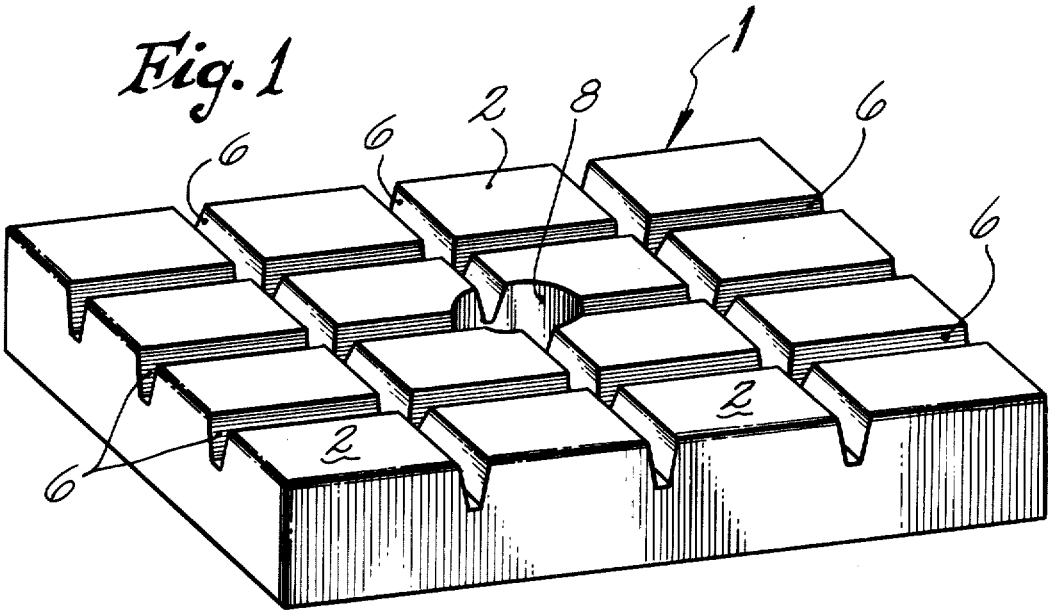
FIG. 1 is a perspective view of the preformed ceramic firing base.

Shown in FIG. 1 is a typical preformed ceramic firing base 1 of the present invention. The ceramic firing base has a working surface generally square in shape and having substantially the same lateral dimensions as the base of the green ceramic shell mold, for example, a firing base and mold base 6½×6½ inches have been used. The working surface of the ceramic firing base includes a majority of flat surface portions 2 upon which the mold base is supported, thus maintaining mold base flatness throughout firing. The working surface also includes one or more, preferably a plurality, of groove-like surface portions 6 which define gas circulation passages when the mold base is placed in supported relation on the flat surface portions of the firing base. As shown, the groove-like surface portions are arranged in crosshatched fashion across the working surface, the grooves terminating at the edge periphery of the firing base. Preferably, a hole 8 is centrally disposed in the working surface of the firing base and is fed furnace gases by way of the groove-like surfaces. In actual firing of the shell mold 16, FIG. 3, the open bottom end 16a of the mold which is the mold base is centered over the hole 8, thereby establishing gas circulation into the mold during firing to minimize hot spots therein which can result in mold cracking, bulging and the like. It is important that the dimensions, especially the width, of the surface grooves and their spacing be selected such that the portions of the mold base spanning the grooves do not deform or conform thereto during firing. Of course, it will be apparent that the dimensions, spacing and arrangement of the surface grooves may be varied depending upon the strength of the mold base, firing temperatures, and other factors. However, workable parameters can be readily determined by suitable experimental firing trials or other means. By way of example only, for the 6½×6½ inch and one inch thick firing base shown, surface grooves spaced apart from centerline to centerline by 1⅝ inches and having a depth of ⅜ inch and bottom width of ⅛ inch with 10° outwardly tapering sidewalls have been found satisfactory in providing the desired gas circulation through the shell mold without causing the mold base to deform downwardly into the grooves, the mold and base being made of alumina or zircon ceramic by the lost wax process and fired at 1800° F. for 1.5 hours.

Of course, the ceramic firing base must be capable of sustaining the temperature of firing, preferably repeatedly, without losing the uniform flatness of the flat surface portions 2. To this end, the firing base should be made of a heat and thermal shock resistant ceramic or mixture thereof. For example, for the shell mold described above which is fired at about 1800° F. for 1.5 hours, a firing base made of 85% $Al_2O_3$ and 15% $ZrO_2$.-$SiO_2$, by weight, is satisfactory and preferred. Of course, other well known ceramics can be employed as desired for other firing temperatures.

Figure 3:
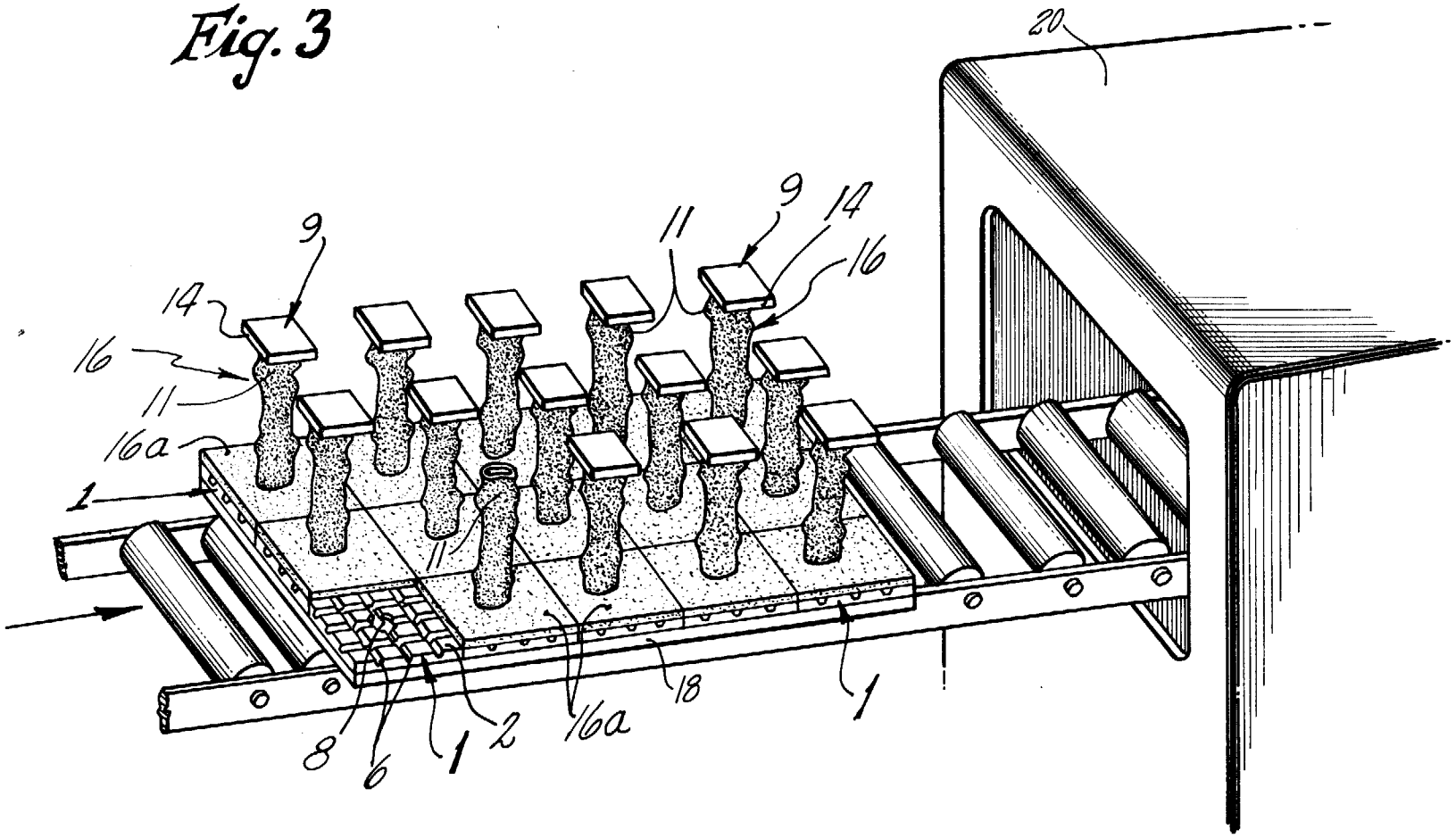
FIG. 3 is a perspective showing a plurality of green shell molds positioned on individual firing bases and covered by individual firing caps for insertion into a firing furnace.

From FIG. 3, those skilled in the art will recognize that the ceramic firing base is especially advantageous when a plurality of individual ceramic shell molds are to be fired simultaneously. For example, when the firing bases are placed in side by side relation on a support plate 18 so that the open ends of the gas circulation passages around the edge peripheries are placed in opposed gas flow relation, FIG. 3, the entire group of shell molds can be fired together in a furnace 20 while maintaining uniform mold base flatness for each and circulating furnace gases through each to minimize hot spots. In this arrangement, it is apparent that the gas passages formed between the mold bases and firing bases provide a more or less continuous network of intersecting passages for supplying gas to the bottom opening of each mold. Of course, the quality and uniformity of the final shell molds is increased by firing the green molds under these conditions.

Figure 2:
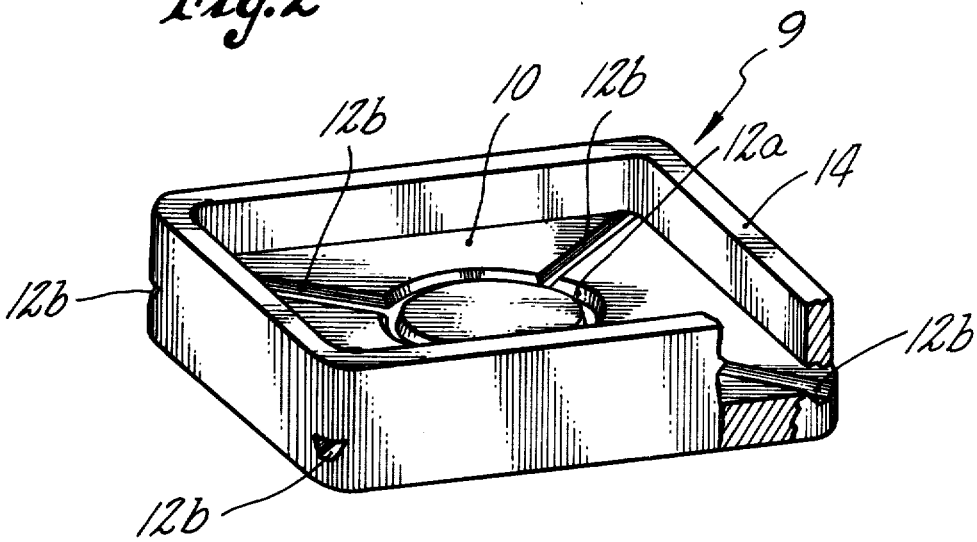
FIG. 2 is a perspective of a preformed ceramic firing cap in inverted position so that the working surface can be seen.

A typical preformed ceramic firing cap 9 useful in conjunction with the firing base described above is shown in FIGS. 2 and 3. It can be seen that the cap includes a working surface generally square in shape, the surface including flat surface portions 10 which rest on the top of the shell mold, for example, on the pour cup 11 as shown in FIG. 3, and groove-like surface portions, such as annular portion 12a and diagonal portions 12b, which define gas circulation passages when the cap is placed atop the mold. The diagonal groove portions 12b terminate to the outside atmosphere at the corners of the cap to provide desired circulation. If desired, the cap can be provided with flanges 14 which extend downwardly when the cap is placed atop the mold, the flanges preventing the cap from being slidably moved off the mold by accidental encounters. Of course, in addition to providing gas circulation through the mold, the firing cap also prevents foreign particulate, such as dust, in the firing furnace 20 from entering the shell mold.

Although the invention has been shown and described with respect to certain preferred embodiments, those skilled in the art will recognize that changes and modifications can be made. For example, the groove pattern in the base and cap can be varied as desired to achieve proper circulation. The shape of the base and cap need not be square but any desired shape to suit a particular mold shape.

Having thus described typical embodiments of my invention, that which I claim as new and desire to secure by Letters Patent of the United States is:

1. A preformed ceramic base useful for firing a ceramic shell mold having an open bottom end and a mold cavity in communication therewith, comprising:

a ceramic member having a preformed working surface which includes a majority of flat surface portions on which the mold base is suported and maintained with desired flatness during firing and one or more groove-like surface portions which define one or more gas circulation passages from the outside atmosphere into the open bottom end of the mold adjacent the ceramic base when the open bottom end of the mold is placed in supported relation on the flat surface portions, said passages permitting gas circulation through the mold interior during firing to minimize hot spots therein.

2. The ceramic firing base of claim 1 which includes a working surface having substantially the same lateral dimensions and shape as the open bottom end of the mold to be placed thereon.

3. The ceramic firing base of claim 2 wherein the working surface is square in shape.

4. The ceramic firing base of claim 1 wherein a plurality of groove-like surfaces are provided in a cross-hatched arrangement in said working surface, the groove-like surfaces extending across the working surface and terminating at the edge periphery thereof in spaced apart locations, said groove-like surfaces defining a network of intersecting gas circulation passages when the open bottom end of the mold is placed in supported relation on the flat surface portions, said passages being in communication with the outside atmosphere at their terminating locations along the edge periphery and with the open portion of the open bottom end of the mold adjacent the firing base.

5. The ceramic firing base of claim 1 wherein the base is made of a heat and thermal shock resistant ceramic.

6. A preformed ceramic base and cap useful for firing a ceramic shell mold having an open top end and an open bottom end which is the mold base, comprising:

(a) a ceramic base member having a preformed working surface which includes a majority of flat surface portions on which the mold base is supported and maintained with the desired flatness throughout firing and one or more groove-like surface portions which define one or more gas circulation passages from the outside atmosphere into the open bottom end of the mold adjacent the ceramic firing base when the mold base is placed in supported relation on the flat surface portions;

(b) a ceramic cap member having a preformed working surface which includes a majority of flat surface portions which rest on the open top end of the shell mold opposite the mold base and one or more groove-like surface portions which define one or more gas circulation passages between the outside atmosphere and said open top end of the shell mold when the flat surface portions are placed on said open end, said cap member preventing foreign particulate in the firing furnace from entering the shell mold;

(c) said gas circulation passages defined by the firing base and cap at opposite ends of the shell mold permitting gas circulation through the mold interior during firing to minimize hot spots therein.

7. The ceramic base and cap of claim 6 wherein the base working surface has substantially the same lateral dimensions and shape as the mold base.

8. The ceramic base and cap of claim 6 wherein the base working surface includes a plurality of groove-like surfaces in a cross-hatched arrangement, the groove-like surfaces extending across the working surface and terminating at the edge periphery thereof in spaced apart locations, and wherein the cap working surface includes a centrally disposed annular groove-like surface and a plurality of linear groove-like surfaces extending radially from the annular surface to the edge periphery of the cap where they terminate in spaced apart locations; said groove-like surfaces establishing a plurality of gas circulation passages into the mold at opposite ends thereof when the ceramic base and cap are placed in working relation to the shell mold, the passages being in communication with the outside atmosphere at their terminating locations along the edge periphery of said ceramic base and cap.

9. The ceramic firing base and cap of claim 6 wherein the base and cap are made of a heat and thermal shock resistant ceramic.

10. A method for firing a plurality of ceramic shell molds having open bottom ends which are the mold bases and open top ends, comprising:

(a) providing a plurality of preformed ceramic firing bases, each base including a preformed working surface which comprises a majority of flat surface portions on which the mold base is supported and maintained with desired flatness throughout firing and one or more groove-like surface portions extending across the working surface and terminating at the edge periphery at spaced apart locations to define one or more gas circulation passages when the mold base is placed in supported relation on the flat surface portions thereof, said passages being in communication with the outside atmosphere at their terminating locations along the edge periphery of the ceramic firing base and with an opening in the open bottom end adjacent the firing base;

(b) placing each ceramic shell mold on a ceramic firing base so that the mold base is in supported relation on the flat surface portions of the working surface and the gas circulation passages are defined therebetween, and arranging the ceramic firing bases in working relation to one another such that the terminating locations of the gas circulation passages of one firing base are in opposed gas flow relation with those of an adjacent firing base, thereby providing a more or less continuous network of interconnected passages to permit gas circulation through each shell mold during firing to minimize hot spots therein.

11. The method of claim 10 further comprising the step of (c) placing over the open top end of each shell mold which is opposite the mold base, a firing cap comprising a ceramic member having a working surface which includes a majority of flat surface portions which rest on said open top end and one or more groove-like surface portions which define one or more gas circulation passages between the outside atmosphere and said open end of the shell mold when the flat surface portions are placed on said open end, said cap preventing foreign particulate from entering each shell mold and, in conjunction with the firing base, providing gas circulation passages at opposite ends of each shell mold for permitting gas circulation through each mold interior during firing to minimize hot spots therein.

* * * * *